United States Patent [19]

Gall

[11] Patent Number: 4,602,780

[45] Date of Patent: Jul. 29, 1986

[54] MULTIPURPOSE EXERCISE APPARATUS

[75] Inventor: John C. Gall, Chicago, Ill.

[73] Assignee: Sears, Roebuck and Co., Chicago, Ill.

[21] Appl. No.: 631,239

[22] Filed: Jul. 16, 1984

[51] Int. Cl.[4] ..... A63B 69/06; A63B 21/00

[52] U.S. Cl. ..... 272/72; 272/130; 272/134; 272/144

[58] Field of Search ..... 272/72, 144, 134, 93, 272/73, 130; 403/378, 379

[56] References Cited

U.S. PATENT DOCUMENTS

| | | | |
|---|---|---|---|
| D. 268,278 | 3/1983 | Smith . | |
| 3,473,843 | 10/1969 | Hart . | |
| 3,545,748 | 12/1970 | Delinger . | |
| 3,614,097 | 10/1971 | Blickman . | |
| 3,658,327 | 4/1972 | Thiede . | |
| 3,659,844 | 5/1972 | Cummins . | |
| 3,709,487 | 1/1973 | Walker . | |
| 3,741,538 | 6/1973 | Lewis et al. . | |
| 3,758,111 | 9/1973 | Agamian | 272/73 |
| 3,770,267 | 11/1973 | McCarthy . | |
| 3,819,176 | 6/1974 | Cummins . | |
| 3,912,264 | 10/1975 | Busse et al. . | |
| 4,284,272 | 8/1981 | Evans et al. . | |
| 4,286,782 | 9/1981 | Fuhrhop . | |
| 4,403,773 | 9/1983 | Swann . | |
| 4,477,071 | 10/1984 | Brown et al. | 272/130 X |

OTHER PUBLICATIONS

Amerec 610 Advertisement–Date 2/1982.

*Primary Examiner*—Robert E. Bagwill
*Assistant Examiner*—Kathleen D'Arrigo
*Attorney, Agent, or Firm*—Silverman, Cass, Singer & Windburn, Ltd.

[57] ABSTRACT

A multipurpose exercise apparatus has a pair of interchangeable lever arm assemblies which can be moved to provide a plurality of exercise positions. The apparatus has a frame with a seat on the frame and the lever arm assemblies are interchangeably mounted on opposite sides of the ends of the frame in various configurations to provide the exercise positions.

25 Claims, 7 Drawing Figures

MULTIPURPOSE EXERCISE APPARATUS

BACKGROUND OF THE INVENTION

The invention relates generally to exercise machines and more particularly to a rowing type multipurpose exercise apparatus. The exercise apparatus is designed to be convertible into a number of different configurations to provide a multiplicity of exercise positions.

In the exercise equipment field, numerous types of rowing exercise machines have been provided which provide a basic rowing exercise position. Generally, these machines provide an elongate frame with a seat slidably engaged on the frame, foot rests at one end of the frame and a lever arm or arms biased to provide resistance to the conventional rowing action. These machines are limited to providing the basic rowing exercise position and do not provide a variety of exercise positions.

Some attempts have been made to provide rowing exercise machines with a number of exercise positions beyond the basic rowing position. One such machine includes a member which can be mounted adjacent the foot rests at one end of and perpendicular to the frame. This machine can then be tilted on end to rest on the member to provide some additional exercise positions. It would, however, be desirable to provide additional positions without moving the machine frame.

Therefore, there is a need for an improved multipurpose exercise apparatus which provides for a multiplicity of exercise positions and which is easily convertible into the positions without moving the machine frame and without tools or other complicated mechanisms.

SUMMARY OF THE INVENTION

The above and other disadvantages of the prior art exercise apparatus and techniques are overcome in accordance with the present invention by providing a multipurpose exercise apparatus which is easily convertible into a multiplicity of different exercise configurations. The multipurpose apparatus has a frame, a seat mounted on the frame and a pair of interchangeable lever arm assemblies which are detachably secured to the frame and are movable to different positions to provide the multiplicity of exercise positions without substantially changing the position of the frame.

The lever arm assemblies preferably have free ends which are mechanically engaged on opposite sides of either end of the frame. The apparatus can include a pair of C-shaped arms which can be mechanically engaged in the frame in the opposite end to the lever arm assemblies to either provide a handgrip or an elevation member for the frame.

DESCRIPTION OF THE PREFERRED EMBODIMENTS

Figure 1:
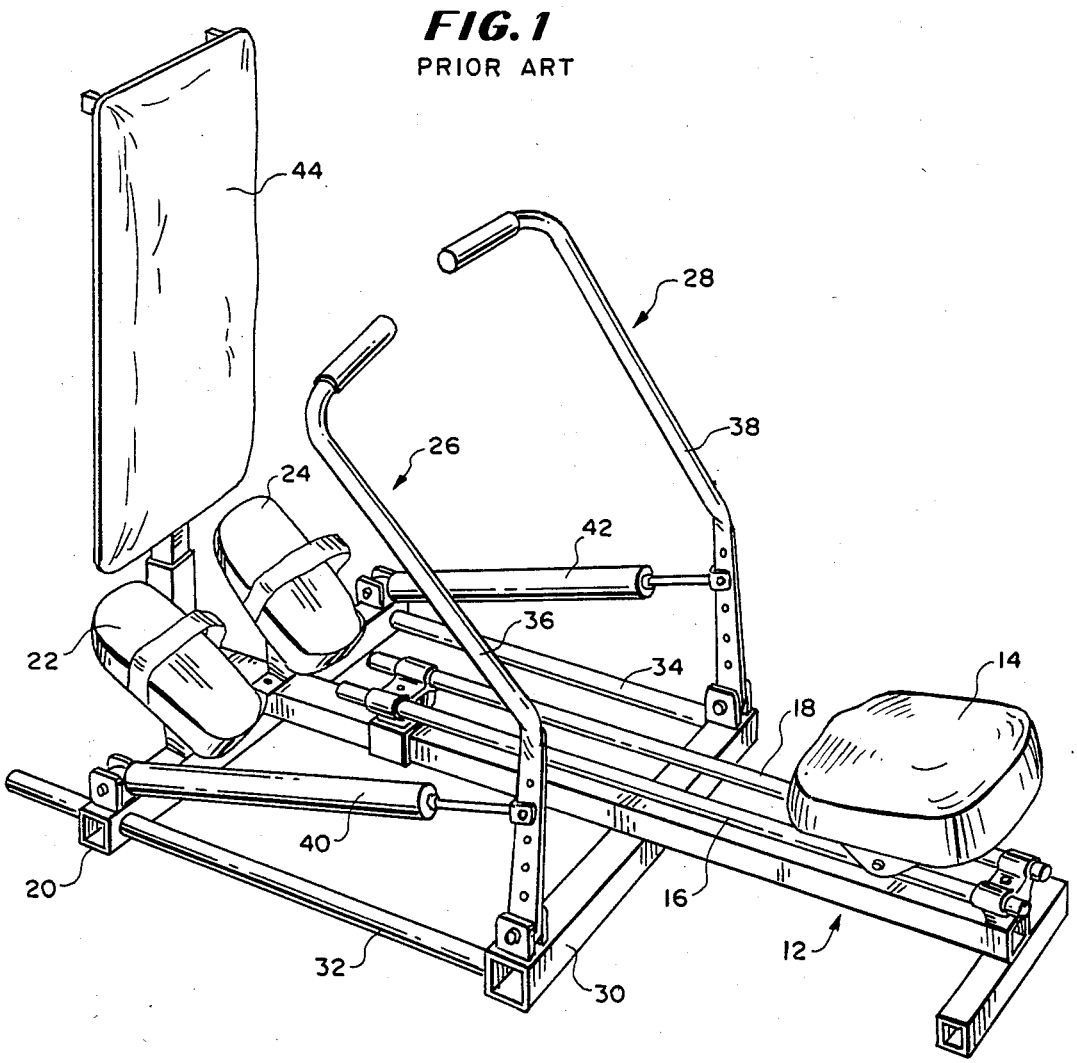
FIG. 1 PRIOR ART
FIG. 1 is a perspective view of a prior art rowing exercise machine.

Referring to FIG. 1, a prior art exercise machine 10 is illustrated. The machine 10 includes a frame 12 and a seat 14 movably mounted on a pair of frame bars 16 and

18. The frame 12 includes a crosspiece 20 onto which are mounted a pair of foot rests 22 and 24.

The machine 10 includes a pair of lever arm assemblies 26 and 28 mounted onto a second crosspiece 30. The crosspiece 30 is secured to the frame 12 and to the first crosspiece 20 by a pair of support rods 32 and 34. The assemblies include respective lever arms 36 and 38 pivotably mounted on the crosspiece 30. The arms 36 and 38 are respectively biased against the conventional rowing action by respective shocks 40 and 42. The shocks 40 and 42 are pivotably mounted to the crosspiece 20 and are adjustably mounted to the respective lever arms 36 and 38.

In the basic frame position illustrated, only the single conventional rowing exercise can be performed by a person seated on the seat 14. The machine 10 includes a back rest member 44, which can be mounted on the tubes 16 and 18 (not illustrated) to provide some reclined exercise positions. Further, the member 44 can be mounted perpendicular to the frame 12 (as illustrated) and the whole machine 10 can be tilted to rest on the member 44 to provide some additional exercise positions. The machine 10 does not conveniently provide a push row position, since the seat 14 is not movable far enough toward the foot rests 22 and 24.

Figure 2:
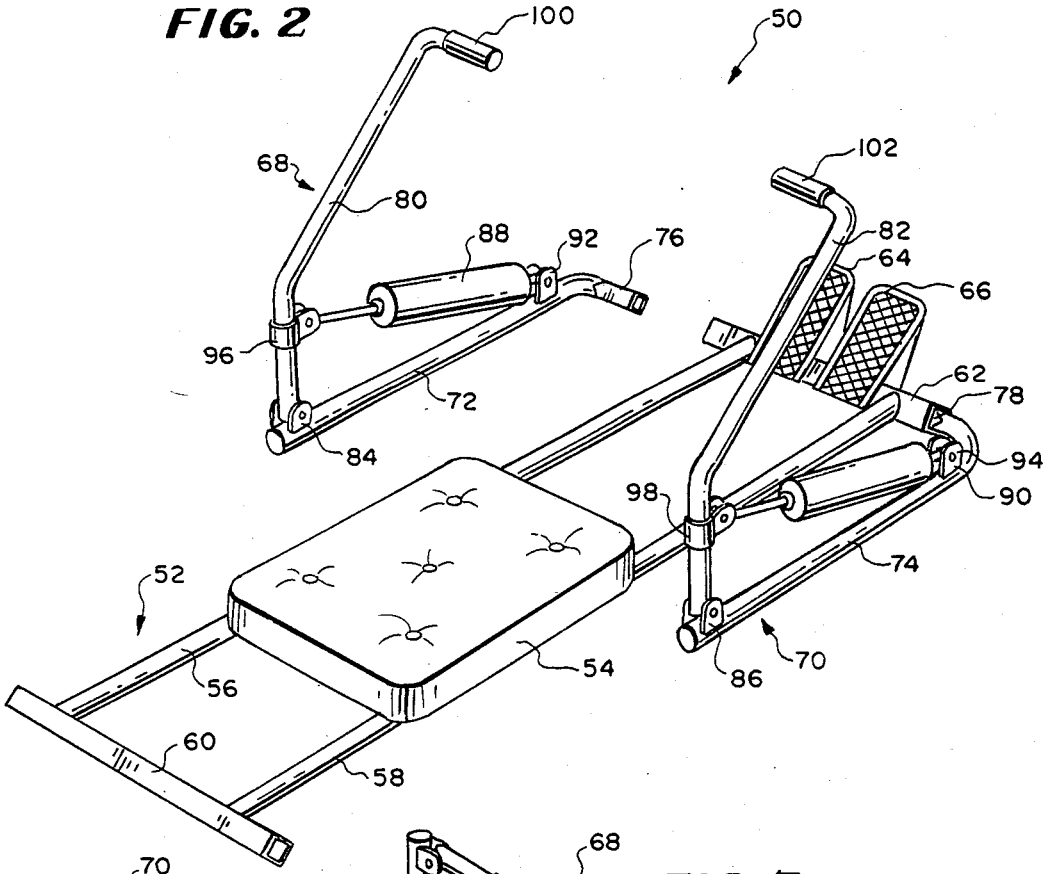
FIG. 2 is a perspective view of a multipurpose exercise apparatus embodying the present invention, illustrating a first exercise position.

Referring now to FIG. 2, a multipurpose exercise apparatus or machine embodying the present invention is designated generally by the reference numeral 50. The machine 50 includes a frame support 52, which can be any of a variety of configurations such as a single beam, which preferably provides for the reciprocal movement of a seat 54 mounted on the frame 52. Although the seat 54 is preferably movable, it can also be a single fixed seat or be provided with a number of fixed locations. The frame 52 is illustrated as formed by a pair of bars or rods 56 and 58 secured to a pair of end crosspieces or crossbars 60 and 62. The front crosspiece 62 can include a pair of foot rests 64 and 66 secured thereto. The foot rests 64 and 66 can also be adjustable as will be discussed with respect to FIG. 7.

The machine 50 includes a pair of lever arm assemblies 68 and 70. The assemblies 68 and 70 are similar to those provided in the prior art; however, the prior art assemblies are secured to the frame 50 in a single fixed position, which does not provide a multiplicity of exercise positions. In contrast, as will be further described hereinafter, the assemblies 68 and 70 are detachably secured to the frame 50 and are interchangeable with one another and can be secured to both ends of the frame 50 to provide the multipurpose exercise apparatus of the invention.

The assemblies 68 and 70 include respective support arms 72 and 74. The end crosspieces 60 and 62 can be formed from hollow square tubing and the arms 72 and 74 can include primary mounting ends 76 and 78 having a configuration which is slideable into and mechanically engageable with the open ends of the crosspieces 60 and 62. The arms 72 and 74 can be pinned or have snap connection fittings with the crosspieces 60 and 62, if desired. Each of the crosspieces or crossbars 60 and 62 provide a mounting location on the support frame 52 for the lever arm assemblies 68 and 70. Each of the mounting locations further provide a mounting position on each side of the frame, such as formed by the engagable open ends of the crosspieces 60. Further, although the arms 72 and 74 are illustrated with an L-shaped configuration, th arms can be of other configurations, such as straight members which can be inserted through the crosspieces 60 and 62.

The arms 72 and 74 have respective lever arms 80 and 82 pivotably mounted thereon at second substantially free ends thereof, such as by pivot brackets 84 and 86. The terminology primary mounting leads and substantially free ends of the support arms 72 and 74 are designated as such, because other pieces could be added to provide additional support or stabilizing of the support arm within the scope of the invention. The lever arms 80 and 82 are mounted to pivot in a plane substantially parallel to the length of the frame 52. Resistance is provided to the pivoting of the lever arms 80 and 82 by respective tensioning members, such as shock absorbers 88 and 90.

The shock absorbers 88 and 90 preferably are pivotably mounted to the arms 72 and 74 by brackets 92 and 94 and can be pivotably and adjustably mounted to the lever arms 80 and 82 by brackets 96 and 98. The brackets 96 and 98 can be adjusted along the lever arms 80 and 82 to vary the resistance applied to the lever arm 80 and 82. In the rowing position illustrated, an operator would sit on the seat 54 with their feet on the foot rests 64 and 66 to pull the lever arms 80 and 82, preferably by respective handgrips 100 and 102. The shock absorbers 88 and 90 would provide resistance in the extension movement, but only a small amount or no resistance in the compression movement. This exercise position provides a basically horizontal arcuate path for the lever arms 80 and 82.

Figure 3:
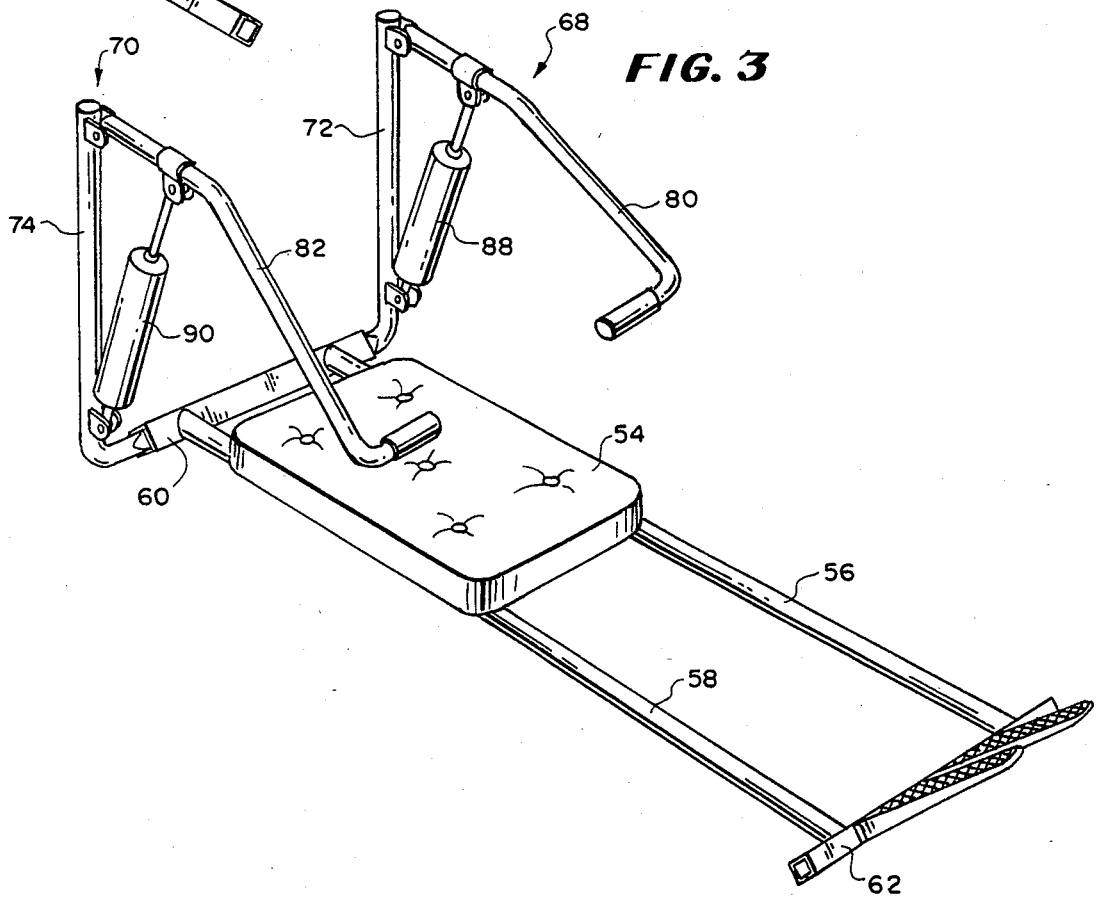
FIGS. 3–7 are perspective views of the apparatus of FIG. 2, illustrating other exercise positions.

FIG. 3 illustrates a second exercise position which provides a substantially vertical arcuate path with resistance to an upward motion. The lever arm assemblies 68 and 70 are removed from the crosspiece 62 and inserted into the crosspiece 60 with the arms 72 and 74 in an essentially vertical position.

Figure 4:
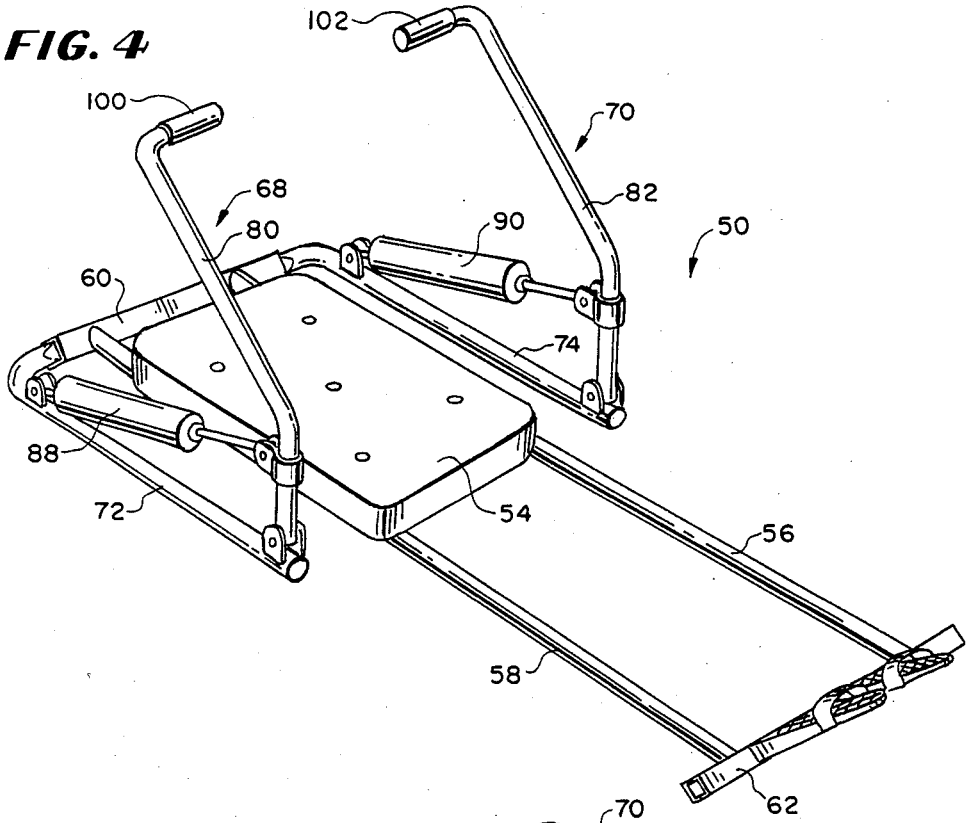

A reverse rowing position is illustrated in FIG. 4, which provides a basically horizontal arcuate path for the lever arms 80 and 82, but with resistance in the opposite direction to that of the position illustrated in FIG. 2. In this push rowing position, the lever arm assemblies 68 and 70 have been reversed side to side from FIG. 3 and the arms 72 and 74 are placed in an essentially horizontal position.

Figure 5:
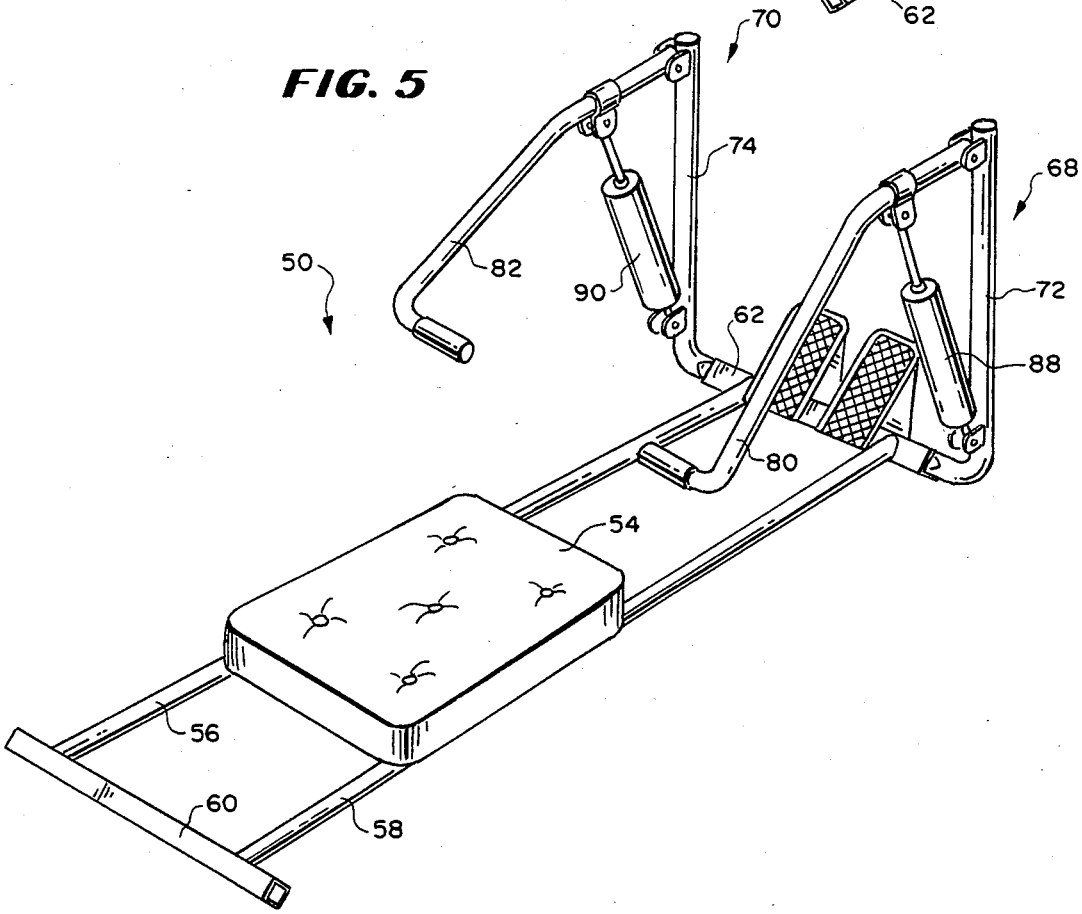

A curl exercise position is illustrated in FIG. 5, which provides a basically vertical arcuate path with resistance to an upward motion. The lever arm assemblies 68 and 70 remain reversed, but are now inserted into the crosspiece 62 with the arms 72 and 74 in an essentially vertical position.

Figure 6:
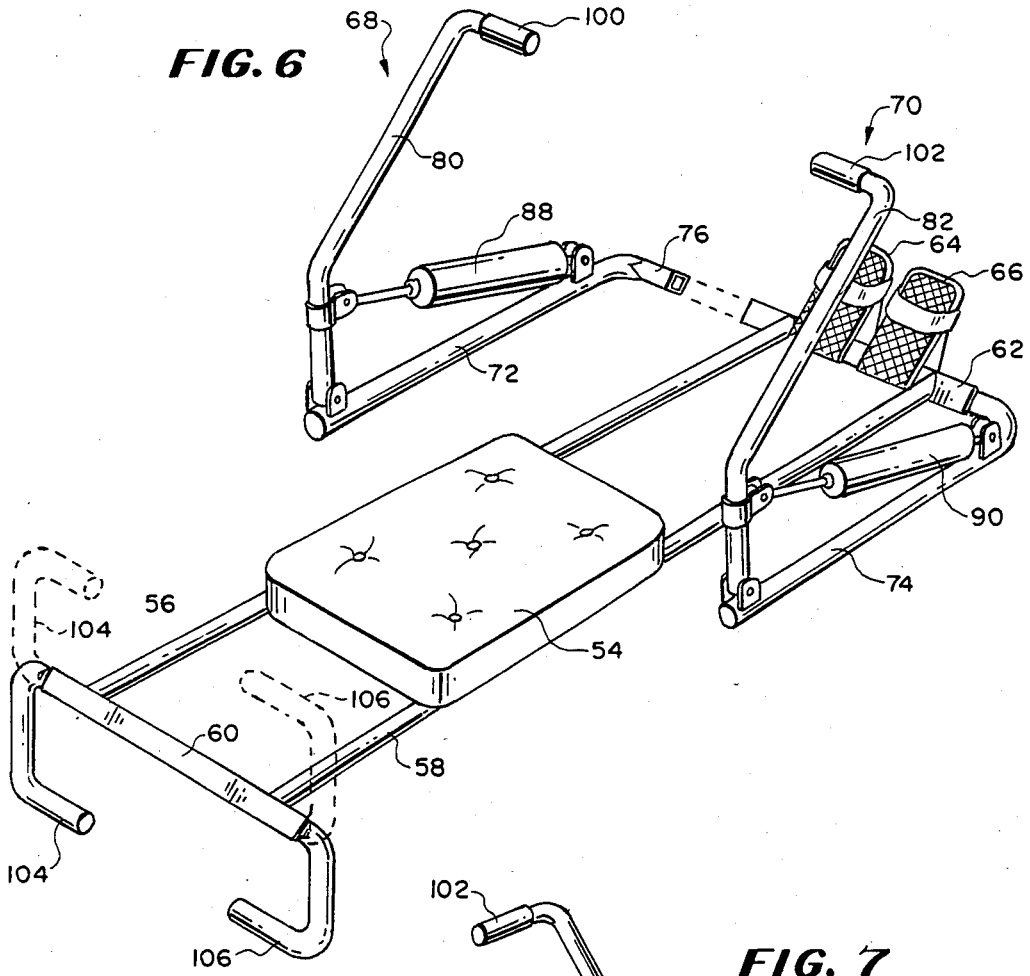

The machine 50 can be provided with a pair of C-shaped insert members 104 and 106 as illustrated in FIG. 6. In a first position, the members 104 and 106 have one end inserted into the crosspiece 60, which end can be configured to conform to the inside of the crosspiece 60. In this position, the members 104 and 106 provide an inclined plane for the machine 50 for the rowing exercise. In a second position, illustrated in phantom, the members 104 and 106 provide hand holds for an operator kneeling on the seat 54. In this position, the operator can move the seat back and forth to exercise the stomach muscles.

Figure 7:
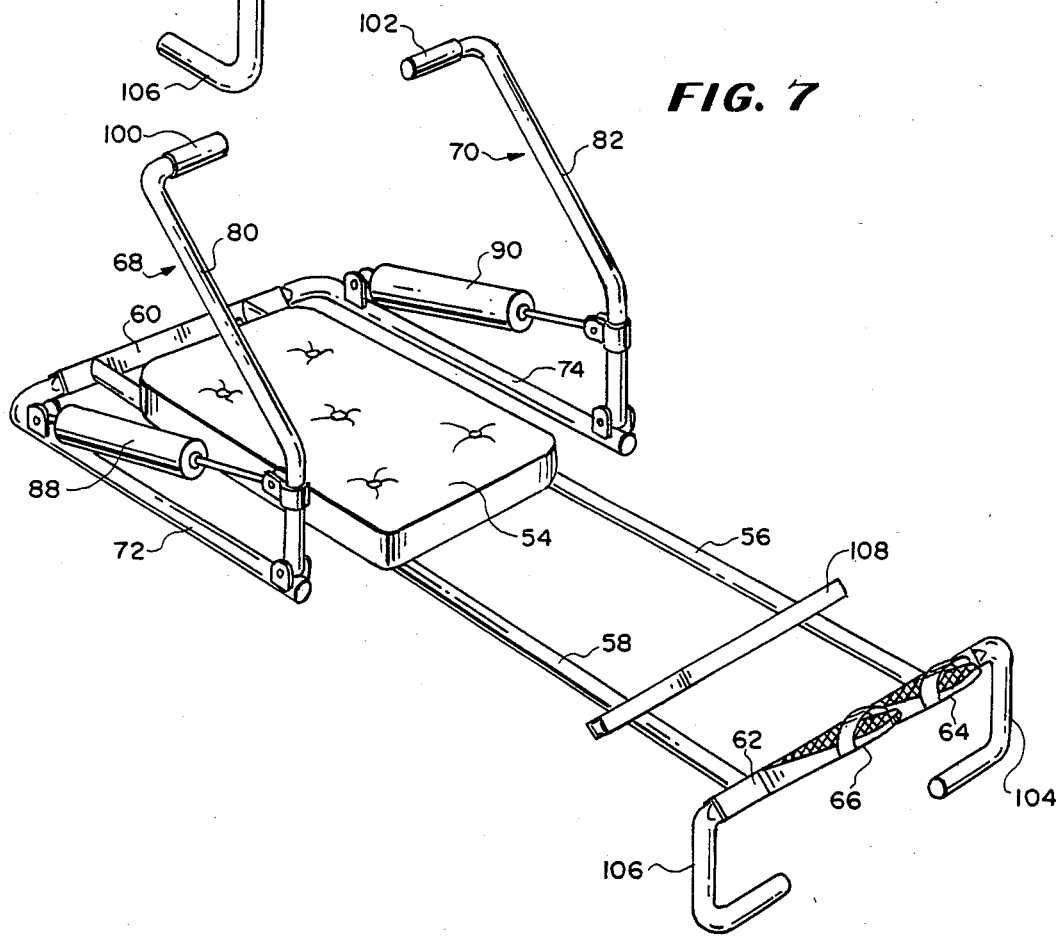

The members 104 and 106 can be inserted into the crosspiece 62 to provide an inclined plane for the machine 50, so the operator can perform sit-ups on the machine 50 as illustrated in FIG. 7. The foot rests 64 and 66 can also be adjustable. A third crosspiece 108 can be mounted to the frame rods 56 and 58 and the foot rests 64 and 66 can be detachably mounted to either the crosspiece 62 or the crosspiece 108, such as by pins or other mechanical retaining means. The lever arm assemblies 68 and 70 can also be mounted to the crosspiece 108.

Many modifications and variations of the present invention are possible in light of the above teachings. The shock absorbers 88 and 90 can be any type of resistance members, can provide resistance for both compression and extension movements and can be adjustable in resistance in at least one movement direction. The frame 52 can be any of a number of configurations and can be of an adjustable length if desired. Although a seated exercise position has generally been described, the operator can also utilize the machine in reclined, kneeling or squatting exercise positions. The foot rests 64 and 66 can also be adjustably mounted on the frame rods 56 and 58. It is therefore, to be understood that within the scope of the appended claims, the invention may be practiced otherwise than as specifically described.

What is claimed and desired to be secured by Letters Patent of the United States is:

1. A multipurpose exercise apparatus, comprising:

an elongate support frame, said frame including at least two mounting locations spaced along the length thereof, each of said mounting locations including a pair of positions located substantially opposite one another on opposite sides of said frame;

a seat engaged on said frame; and a pair of lever arm assemblies including means for detachably mounting said assemblies interchangeably substantially opposite one another on said frame in said pair of positions of any of said mounting locations in a variety of exercise positions, each of said lever arm assemblies including a support arm with a first primary mounting end and a second substantially free end from which lever arm means extend, said detachably mounting means including means for coupling said mounting end of said support arm to any one of said mounting location positions.

2. The apparatus as defined in claim 1 wherein each of said lever arm assemblies include said support arm with a lever pivotably mounted on said arm including means for operating resistively in at least one pivot direction.

3. The apparatus as defined in claim 2 wherein said mounting means include at least one transverse crossbar having a pair of open ends affixed substantially at one end of said frame and said mounting end of each said support arm including means mechanically engageable with said open ends of said crossbar in said exercise positions.

4. The apparatus as defined in claim 3 including at least a second transverse crossbar having a pair of open ends affixed substantially at a second end of said frame, with said support arm mechanically engageable means also engageable with said open ends of said second crossbar in said exercise positions.

5. The apparatus as defined in claim 4 wherein said first and second crossbar open ends have a configuration to mate with said support arm mounting ends in a plurality of positions substantially parallel with said elongate frame or substantially perpendicular thereto.

6. The apparatus as defined in claim 2 wherein said levers are mounted on said arms substantially perpendicular thereto.

7. The apparatus as defined in claim 2 wherein said levers include means for operating resistively in both pivot directions.

8. The apparatus as defined in claim 7 wherein said resistively operating means include means for adjusting said resistivity in at least one direction.

9. The apparatus as defined in claim 1 including a pair of C-shaped members including means for detachably securing said members on said frame at the frame end opposite the end said lever arm assemblies are mounted.

10. The apparatus as defined in claim 9 wherein said members are securable to said frame in two opposite positions substantially perpendicular to said frame.

11. The apparatus as defined in claim 1 wherein said lever arm assemblies are reversibly mountable opposite one another substantially at both ends of said frame.

12. In an exercise machine including a frame, a seat mounted on the frame, a foot rest at one end of the frame, a pair of lever arms pivotably mounted on said frame for movement substantially parallel to the frame and means for providing resistance to movement of said lever arms in at least one pivot direction, the improvement comprising:

an elongate support frame, said frame including at least two mounting locations spaced along the length thereof, each of said mounting locations including a pair of positions located substantially opposite one another on opposite sides of said frame; and a pair of lever arm assemblies, one of said pair of lever arms forming part of each lever arm assembly, said assemblies including means for detachably mounting said assemblies interchangeably substantially opposite one another on said frame in said pair of positions of any of said mounting locations in a variety of exercise positions, each of said lever arm assemblies including a support arm with a first primary mounting end and a second substantially free end from which said lever arm extends, said detachably mounting means including means for coupling said mounting end of said support arm to any one of said mounting location positions.

13. The improvement as defined in claim 12 wherein each of said lever arm assemblies include said support arm with a lever pivotably mounted on said arm including means for operating resistively in at least one pivot direction.

14. The improvement as defined in claim 13 wherein said mounting means include at least one transverse crossbar having a pair of open ends affixed substantially at one end of said frame and said mounting end of each said support arm including means mechanically engageable with said open ends of said crossbar in said exercise positions.

15. The improvement as defined in claim 14 including at least a second transverse crossbar having a pair of open ends affixed substantially at a second end of said frame, with said support arm mechanically engageable means also engageable with said open ends of said second crossbar in said exercise positions.

16. The improvement as defined in claim 13 wherein said levers include means for operating resistively in both pivot directions.

17. The improvment as defined in claim 16 wherein said resistively operating means include means for adjusting said resistivity in at least one direction.

18. A multipurpose exercise apparatus, comprising:

an elongate support frame, said frame including at least two mounting locations spaced along the length thereof, each of said mounting locations including a pair of positions located substantially opposite one another on opposite sides of said frame;

a seat engaged on said frame; and a pair of lever arm assemblies including means for detachably mounting said assemblies interchangeably substantially opposite one another adjacent the ends of said frame in said pair of positions of any of said mounting locations in a variety of exercise positions, said assemblies each including a support arm mountable at one primary mounting end to said frame and having a lever pivotably mounted at the opposite substantially free end of the support arm including means for operating resistively in at least one pivot direction, said detachably mounting means including means for coupling said mounting end of said support arm to any one of said mounting location positions.

19. The apparatus as defined in claim 18 wherein said levers include means for operating resistively in both pivot directions.

20. The apparatus as defined in claim 19 wherein said resistively operating means include means for adjusting said resistivity in at least one direction.

21. The apparatus as defined in claim 18 wherein said mounting means include at least one transverse crossbar having a pair of open ends affixed substantially at one end of said frame and a first end of each said support arm including means mechanically engageable with said open ends of said crossbar in said exercise positions.

22. The apparatus as defined in claim 21 including at least a second transverse crossbar having a pair of open ends affixed substantially at a second end of said frame, with said support arm mechanically engageable means also engageable with said open ends of said second crossbar in said exercise positions.

23. The apparatus as defined in claim 22 wherein said first and second crossbar open ends have a configuration to mate with said support arm mounting ends in a plurality of positions substantially parallel with said elongate frame or substantially perpendicular thereto.

24. The apparatus as defined in claim 18 including a pair of C-shaped members including means for detachably securing said members on said frame at the frame end opposite the end said lever arm assemblies are mounted.

25. The apparatus as defined in claim 24 wherein said members are securable to said frame in two opposite positions substantially perpendicular to said frame.

* * * * *